US007605538B2

(12) United States Patent
Park

(10) Patent No.: US 7,605,538 B2
(45) Date of Patent: Oct. 20, 2009

(54) PLASMA DISPLAY PANEL

(75) Inventor: Yu Park, Seoul (KR)

(73) Assignee: LG Electronics Inc., Seoul (KR)

( * ) Notice: Subject to any disclaimer, the term of this patent is extended or adjusted under 35 U.S.C. 154(b) by 358 days.

(21) Appl. No.: 11/149,330

(22) Filed: Jun. 10, 2005

(65) Prior Publication Data

US 2006/0279211 A1 Dec. 14, 2006

(51) Int. Cl.
*H01J 17/49* (2006.01)

(52) U.S. Cl. ..... 313/582; 313/587

(58) Field of Classification Search ..... 313/582–587
See application file for complete search history.

(56) References Cited

U.S. PATENT DOCUMENTS

| | | | | |
|---|---|---|---|---|
| 6,452,331 | B1 * | 9/2002 | Sakurada et al. | 313/582 |
| 6,469,685 | B1 * | 10/2002 | Woodruff et al. | 345/60 |
| 6,705,584 | B2 * | 3/2004 | Hiroshima et al. | 249/155 |
| 6,912,025 | B2 * | 6/2005 | Lin et al. | 349/110 |
| 7,242,136 | B2 * | 7/2007 | Kim et al. | 313/112 |
| 2001/0004279 | A1 * | 6/2001 | Sako et al. | 349/158 |
| 2002/0033669 | A1 * | 3/2002 | Kanazawa et al. | 313/582 |

FOREIGN PATENT DOCUMENTS

| | | | |
|---|---|---|---|
| JP | 10-322625 | A | 12/1998 |
| KR | 2001-16915 | A | 3/2001 |
| KR | 2001-0048051 | A | 6/2001 |

* cited by examiner

*Primary Examiner*—Nimeshkumar D. Patel
*Assistant Examiner*—Anne M Hines
(74) *Attorney, Agent, or Firm*—Birch, Stewart, Kolasch & Birch, LLP

(57) ABSTRACT

A plasma display panel includes an upper substrate and a lower substrate combined with the upper substrate by a sealant. A black layer is formed on a surface of the upper substrate, outside of a display area of the upper substrate. A film filter, not including a bordering layer, is located on the upper substrate. The film filter includes a ground unit of increased size adjacent its edge, which can electrically engage with a support, thus simplifying an alignment issue during construction of the plasma display and reducing a contact resistance between the ground unit and the support.

14 Claims, 8 Drawing Sheets

PLASMA DISPLAY PANEL

BACKGROUND OF THE INVENTION

1. Field of the Invention

The present invention relates to a plasma display panel, and more particularly, to a plasma display panel in which a ground area of a film-type front filter can be increased.

2. Background of the Related Art

A plasma display panel (hereinafter, referred to as a "PDP") is adapted to display an image, including characters or graphics, by light-emitting phosphors emitting ultraviolet light of 147 nm, generated during the discharge of a gas, such as He+Xe, Ne+Xe or He+Ne+Xe. The PDP can be easily made thin and large, and it can provide greatly increased image quality with the recent development of the relevant technology. Particularly, a three-electrode AC surface discharge type PDP has advantages of lower driving voltage and longer product lifespan, as a voltage necessary for discharging is lowered by wall charges accumulated on a surface upon discharging, and electrodes are protected from sputtering caused by discharging.

FIG. 1 is a perspective view illustrating the structure of a discharge cell of a three-electrode AC surface discharge type PDP, in accordance with the background art. Referring now to FIG. 1, a discharge cell of a three-electrode AC surface discharge type PDP includes a scan electrode Y and a sustain electrode Z, which are formed on the bottom surface of an upper substrate 10, and an address electrode X formed on a lower substrate 18. The scan electrode Y includes a transparent electrode 12Y, and a metal bus electrode 13Y, which has a line width smaller than that of the transparent electrode 12Y and is disposed at one side edge of the transparent electrode 12Y. Further, the sustain electrode Z includes a transparent electrode 12Z, and a metal bus electrode 13Z, which has a line width smaller than that of the transparent electrode 12Z and is disposed at one side edge of the transparent electrode 12Z.

The transparent electrodes 12Y and 12Z, which are generally made of ITO (indium tin oxide), are formed on the bottom surface of the upper substrate 10. The metal bus electrodes 13Y and 13Z are generally formed on the transparent electrodes 12Y and 12Z and made of metal such as chromium (Cr), and serve to reduce a voltage drop caused by the transparent electrodes 12Y and 12Z having high resistance. On the bottom surface of the upper substrate 10, in which the scan electrode Y and the sustain electrode Z are placed parallel to each other, is laminated an upper dielectric layer 14 and a protective layer 16. The upper dielectric layer 14 is accumulated with a wall charge generated during plasma discharging. The protective layer 16 is adapted to prevent damage of the upper dielectric layer 14 due to sputtering caused during plasma discharging, and improve efficiency of secondary electron emission. As the protective layer 16 is generally formed of magnesium oxide (MgO).

A lower dielectric layer 22 and barrier ribs 24 are formed on the lower substrate 18, in which the address electrode X is formed. A phosphor layer 26 is applied to the surfaces of both the lower dielectric layer 22 and the barrier ribs 24. The address electrode X is formed on the lower substrate 18 in the direction in which the scan electrode Y and the sustain electrode Z intersect with each other. The barrier ribs 24 are formed in a stripe or lattice form to prevent ultraviolet and visible light, generated by discharging, from leaking toward adjacent discharge cells. The phosphor layer 26 is excited with an ultraviolet light generated during the plasma discharging to generate any one visible light of red, green and blue lights. An inert mixed gas is injected into the discharge spaces defined between the upper substrate 10 and the barrier ribs 24, and between the lower substrate 18 and the barrier ribs 24.

This PDP is time-driven with one frame being divided into a plurality of sub-fields having a different number of emission in order to implement gray scales of an image. Each of the sub fields is divided into an initialization period for initializing the entire screen, an address period for selecting a scan line and selecting a cell from the selected scan line, and a sustain period for implementing gray scales according to the number of discharging cycles. For example, if it is desired to display an image with 256 gray scales, a frame period (16.67 ms) corresponding to 1/60 seconds is divided into eight sub-fields SF1 to SF8, as shown in FIG. 2. Each of the sub-fields SF1 to SF8 is subdivided into the initialization period, the address period and the sustain period, as described above. The initialization period and the address period of each of the sub-fields SF1 to SF8 are the same every sub-field, whereas the sustain period increases in the ratio of $2^n$ (where, n=0, 1, 2, 3, 4, 5, 6, 7) in each sub-field. In the PDP described above, a front filter is disposed on the upper substrate 10 in order to shield electromagnetic interference and also to prevent reflection of external light.

FIG. 3 schematically shows one side of a POP, in accordance with the background art Referring to FIG. 3, the PDP includes a panel 32 in which an upper substrate 10 and a lower substrate 18 are combined. A front filter 30 is disposed at the front of the panel 32. A cooling fin 34 is disposed at the rear of the panel 32. A printed circuit board 36 is attached to the cooling fin 34. A rear cover 38 is formed to surround the rear of the PDP. A filter support unit 40 connects the front filter 30 and the rear cover 38, and a support member 42 is disposed between the front filter 30 and the rear cover 38 to surround the filter support unit 40.

The printed circuit board 36 supplies driving signals to electrodes of the panel 32. The printed circuit board 36 includes various driving units (not shown). The panel 32 displays a given image according to the driving signal supplied from the printed circuit board 36. The cooling fin 34 dissipates heat generated from the panel 32 and the printed circuit board 36. The rear cover 38 serves to protect the panel 32 from external shock and also to shield electromagnetic interference (hereinafter, referred to as "EMI") discharged from the rear side of the panel 32.

The filter support unit 40 electrically connects the front filter 30 to the rear cover 38. Such a filter support unit 40 grounds the front filter 30 to the rear cover 38, and also prevents EMI from being discharged laterally. The support member 42 supports the filter support unit 40, the front filter 30 and the rear cover 38.

The front filter 30 shields EMI and also prevents reflection of external light. For this, the front filter 30 includes an anti-reflection film 50, an optical characteristic film 52, a glass 54, an EMI shield film 56, and a near infrared (hereinafter, referred to as "NIR") shield film 58, as shown in FIG. 4. Adhesive layers are formed between the films 50, 52, 54, 56 and 58 of the front filter 30, respectively, to provide adhesion among the films 50, 52, 54, 56 and 58. A black layer 60 is further provided at an upper edge of the front filter 30.

The anti-reflection film 50 prevents externally incident light from reflecting toward the outside again, thus improving the contrast of the PDP. This anti-reflection film 50 is formed on the surface of the front filter 30. The anti-reflection film 50 can be additionally formed on the rear of the front filter 30. The optical characteristic film 52 serves to lower transmittance of the red (R) and the green (G) light among light incident from the panel 32, and to improve an optical characteristic of the PDP by increasing transmittance of the blue (B) light.

The glass 54 serves to prevent the front filter 30 from being damaged due to external shock. In other words, the glass 54 supports the front filter 30 so as to prevent damage of the front filter 30 from external shock. The EMI shield film 56, shields EMI to prevent EMI, which is introduced from the panel 32, from being discharged externally. The NIR shield film 58 shields NIR discharged from the panel 32, and thus prevents NIR of over a given reference from being discharged externally so that signals transmitted using IR, such as signals from a remote controller, can be transmitted normally without interference. The black layer 60 defines a valid display region A/A of the panel 32, and also covers unnecessary, unsightly edge portions of the PDP module.

The front filter 30 is electrically connected to the rear cover 38 through the filter support unit 40, as shown in FIG. 5. This will be below described in more detail. The filter support unit 40 is connected to the rear of the front filter 30 at one lateral side of the front filter 30. The filter support unit 40 is electrically connected to at least one of the EMI shield film 56 and NIR shield film 58. That is, the filter support unit 40 connects the front filter 30 to the rear cover 38, thus shielding EMI and/or NIR.

The front filter 30, in accordance with the background art, uses a glass 54 having a size greater than the upper substrate of the panel 32, so as to prevent the front filter 30 from being broken due to external shock. However, if the glass 54 is included in the layers of the front filter 30, there is a disadvantage in that a thickness of the front filter 30 is enlarged. Further, if the glass 54 is included in the front filter 30, there are problems in that a weight is increased and the manufacture cost is also increased.

In view of these disadvantages, a film-type front filter 70 from which the glass 54 is removed has been proposed. FIG. 6 shows such a film-type front filter 70, in accordance with the background art. The film-type front filter 70 has the same size as the upper substrate of the panel, and includes an anti-reflection film 80, an optical characteristic film 82, an EMI shield film 86 and a NIR shield film 88. Adhesive films are formed between the films 80, 82, 86 and 88 of the film-type front filter 70, respectively, to provide adhesion among the films 80, 82, 86 and 88. The film-type front filter 70 further includes a ground face 72 formed at an edge region of the anti-reflection film 80, and a black layer 90 formed in a region, which is spaced apart from the ground face 72 by a given distance.

The anti-reflection film 80 is formed on a surface of the film-type front filter 70, and serves to prevent externally incident light from being reflecting externally again. This anti-reflection film 80 can be additionally formed at the rear of the film-type front filter 70. The optical characteristic film 82 lowers transmittance of the red (R) light and the green (G) light among light incident from the panel, and also improves an optical characteristic of the PDP by increasing transmittance of the blue (B) light.

The EMI shield film 86 shields EMI to prevent EMI incident from the panel from being discharged externally. The NIR shield film 88 serves to shield NIR incident from the panel. Such a NIR shield film 88 prevents NIR of over a given reference from being discharged externally, so that signals transmitted from a remote controller to the panel can be transmitted normally without interference. The ground face 72 is electrically connected to the rear cover 38, as shown in FIG. 3, through a filter support unit (not shown). The black layer 90 defines a valid display region A/A of the panel, and also covers unnecessary, unsightly edge portions of a the PDP module.

In the PDP having the above-described film-type front filter 70, the film-type front filter 70 is fabricated to have the same size as the upper substrate of the panel. Thus, the ground face 72 and the black layer 90 are formed at the same time. Due to this, there are disadvantages in that the area of the ground face 72 is reduced in size. The reduced size makes it difficult to achieve alignment between the film type front filter 70 and the upper substrate of the panel because spaces for forming the ground face 72 and the black layer 90 are insufficient.

SUMMARY OF THE INVENTION

Accordingly, it is an object of the present invention to address one or more of the drawbacks associated with the background art.

It is an object of the present invention to provide a plasma display panel in which a ground area of a film-type front filter can be increased in size.

It is an object of the present invention to provide a front film-type filter which does not include a black layer.

These and other objects are accomplished by a plasma display panel, comprising: an upper substrate; a lower substrate, arranged below said upper substrate; and a display area bordering layer disposed on a surface of said upper substrate.

Moreover, these and other objects are accomplished by a film filter for a plasma display panel having a display area bordering layer disposed on a surface of an upper substrate of the plasma display panel, said film filter comprising: a plurality of layers, not including a display area bordering layer, wherein said plurality of layers includes at least two of the following films; an anti-reflection film; an optical characteristic film; an electromagnetic interference (EMI) shielding film; and a near infrared (NIR) shielding film.

The PDP may include the film filter disposed on the upper substrate, and a ground unit formed at the edge of the film filter.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENTS

Figure 1:
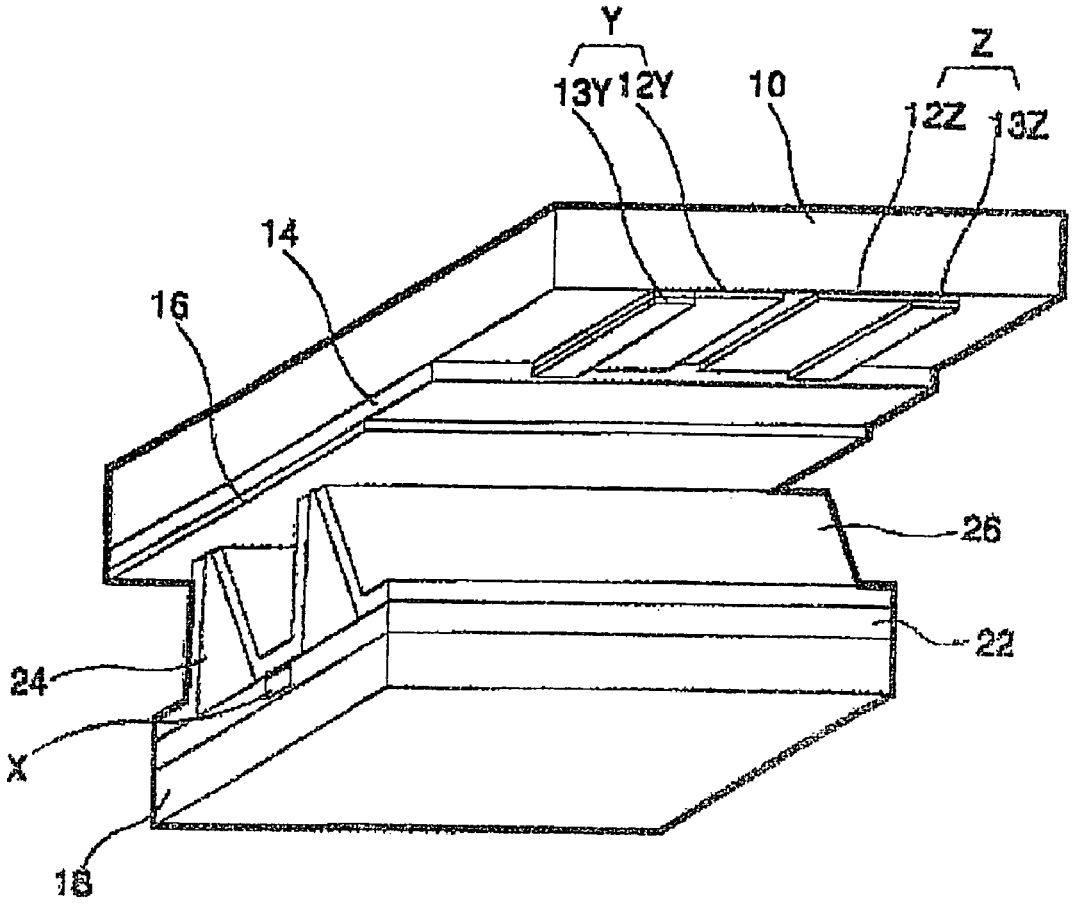
Fig. 1 Background Art
FIG. 1 is a perspective view illustrating the construction of a discharge cell of a three-electrode AC surface discharge type PDP, in accordance with the background art.
Figure 2:
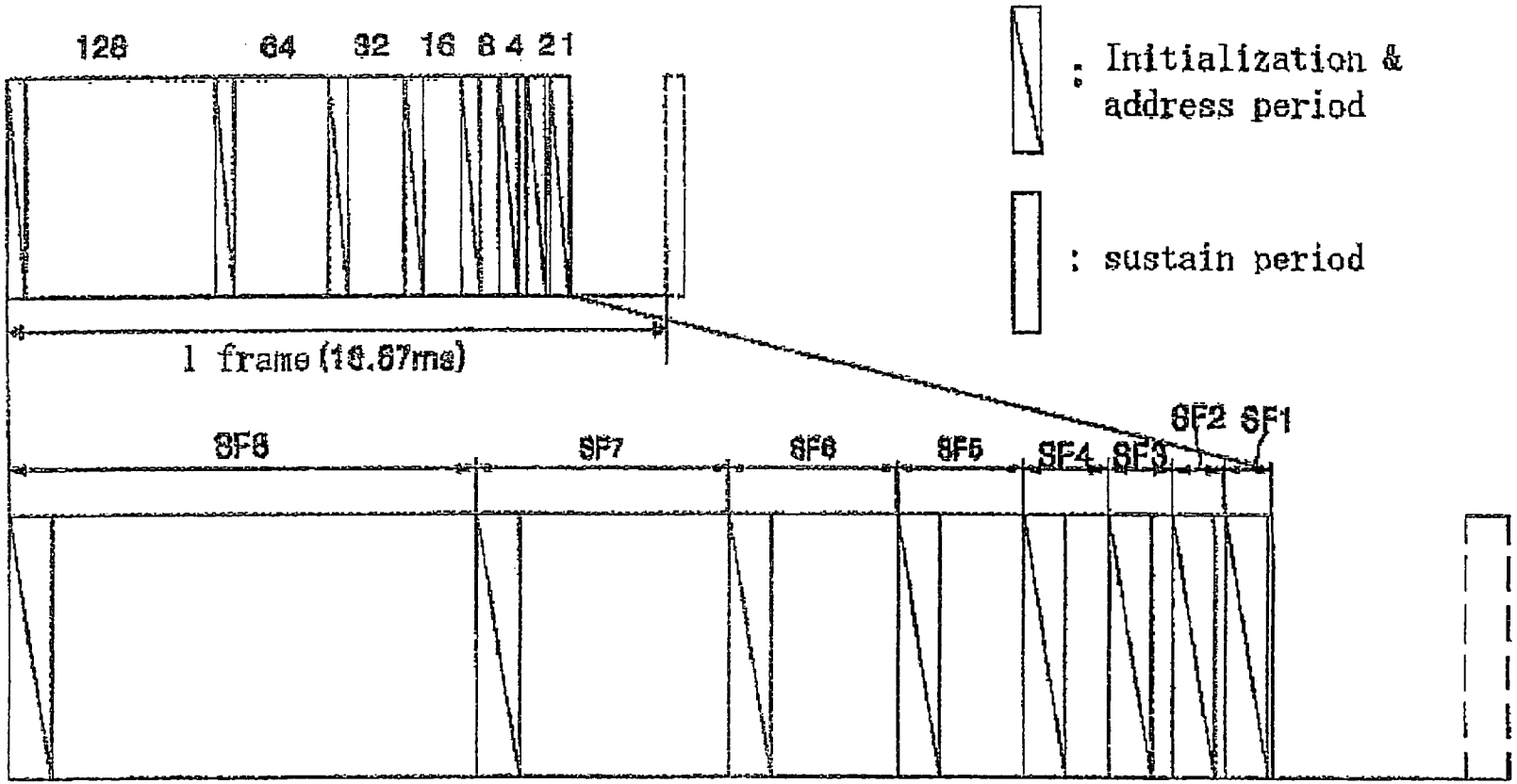
Background Art Fig. 2
FIG. 2 shows a frame for representing 256 gray scales in accordance with a PDP of the background art.
Figure 3:
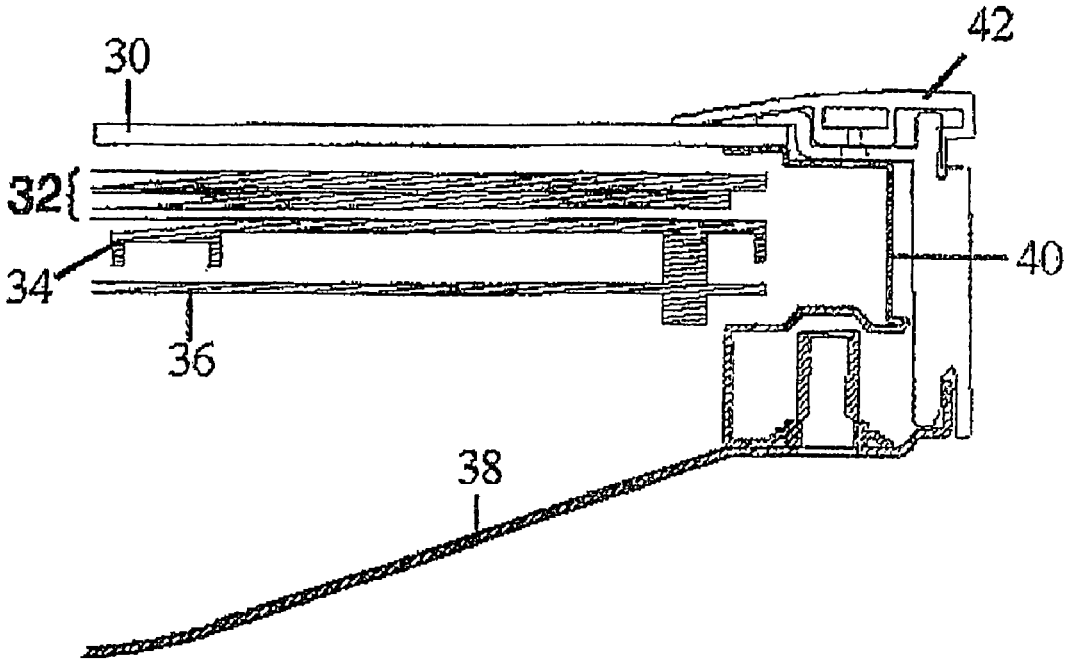
Fig. 3 Background Art
FIG. 3 schematically shows one side of a PDP, in accordance with the background art.
Figure 4:
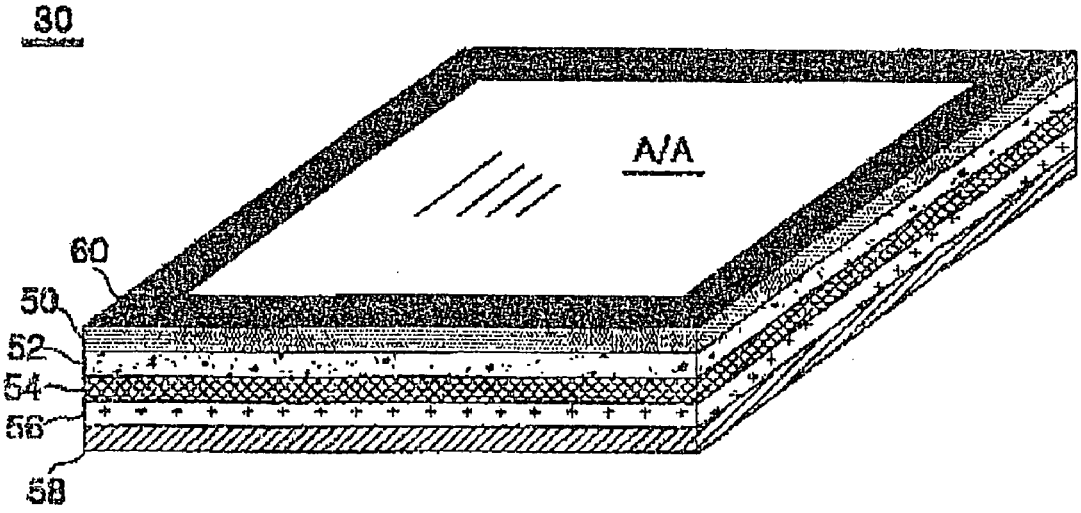
FIG. 4 is a cross-sectional view schematically showing a front filter shown in FIG. 3.
Figure 5:
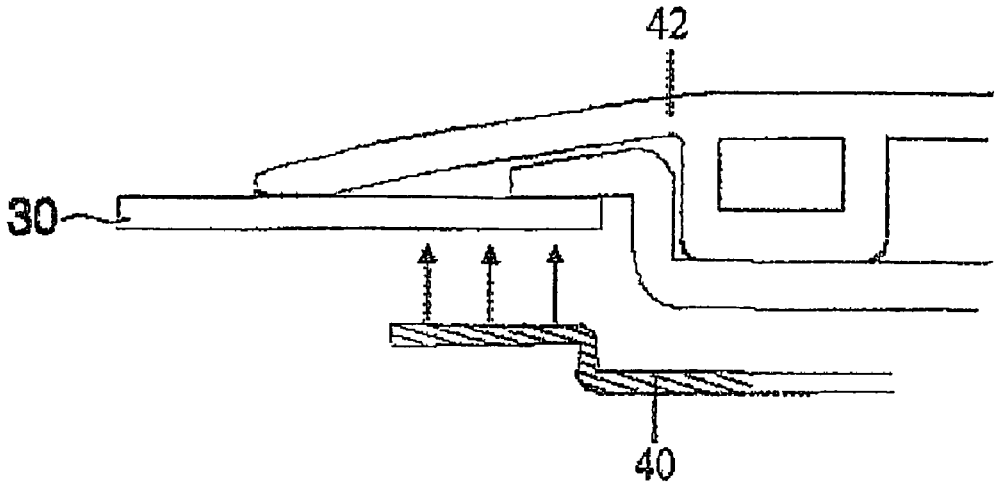
Background Art Fig. 5
FIG. 5 shows a detailed grounding process of the front filter and the filter support unit shown in FIG. 3.
Figure 6:
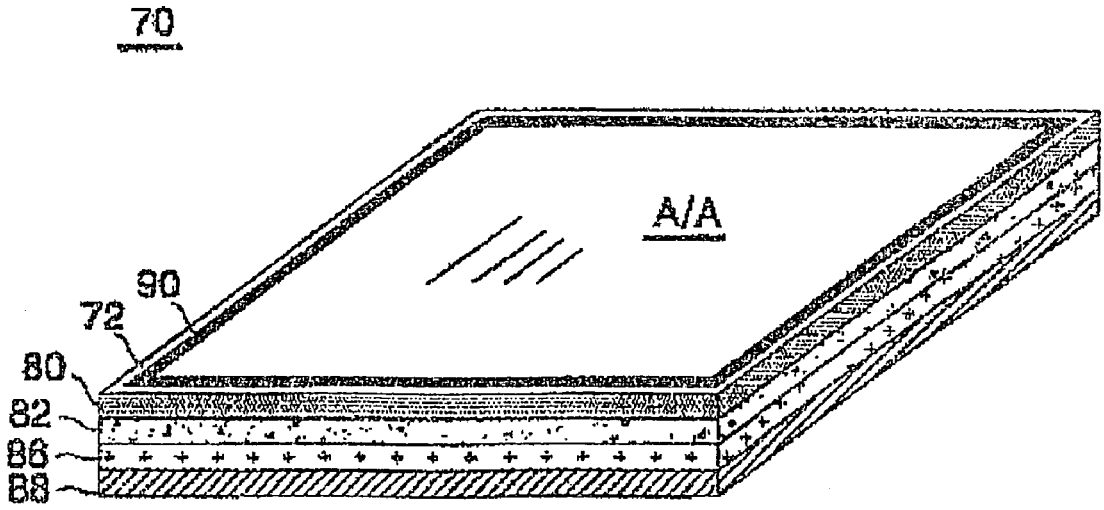
Fig. 6 Background Art
FIG. 6 is a schematic perspective view of a film type front filter, in accordance with the background art.
Figure 7:
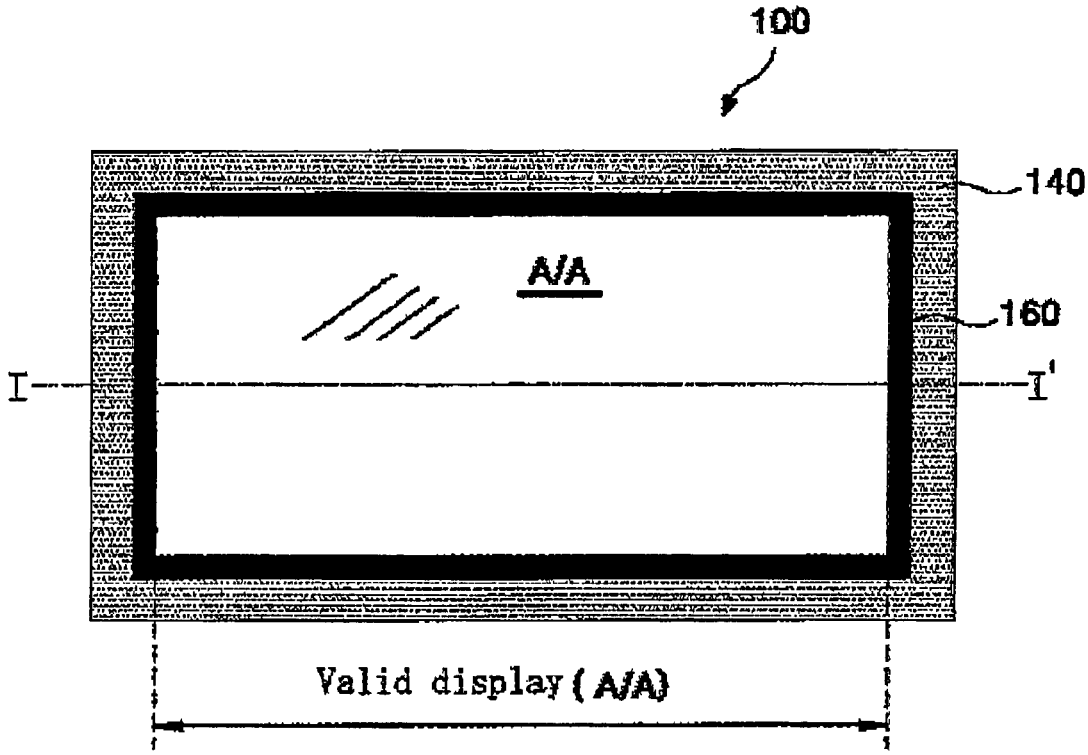
FIG. 7 is a plan view of a PDP according to a first embodiment of the present invention.
Figure 8:
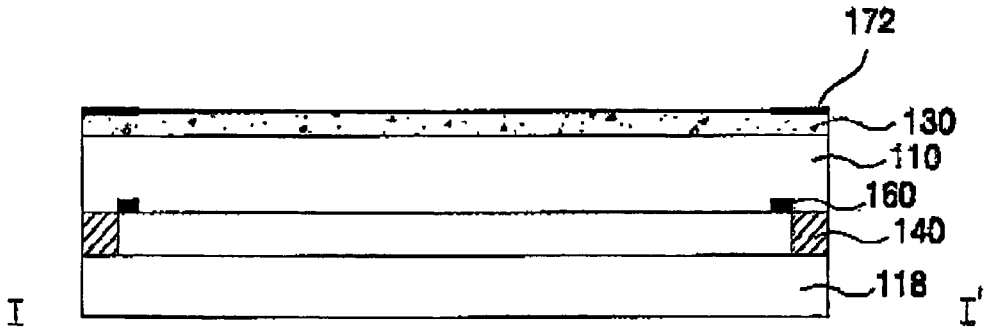
FIG. 8 is a cross-sectional view of the PDP taken along line I-I' in FIG. 7.

Preferred embodiments of the present invention will be described in a more detailed manner with reference to FIGS. 7 to 14. Referring to FIGS. 7 and 8, a plasma display panel (PDP) according to a first embodiment of the present invention includes a plurality of discharge cells formed on a valid display region A/A of a panel 100, a sealant 140 formed at the edges of an upper substrate 110 and a lower substrate 118, for combining the upper substrate 110 and the lower substrate 118, and a black layer 160 formed between the end of the valid display region A/A and the sealant 140.

Each of the plurality of the discharge cells includes a scan electrode and a sustain electrode (not shown), both of which are formed on the upper substrate 110, and an address electrode (not shown) formed on the lower substrate 118. Each of the scan electrode and the sustain electrode includes a transparent electrode, and a metal bus electrode, which has a line width smaller than that of the transparent electrode and is formed at the end of one side of the transparent electrode.

The transparent electrode is mainly made of indium-tin-oxide (ITO), and is formed on the upper substrate 110. The metal bus electrode is mainly made of a metal, such as chrome (Cr), and is formed on the transparent electrode. The metal bus electrode serves to reduce a voltage drop due to the transparent electrode having high resistance. An upper dielectric layer and a protection film are laminated on the upper substrate 110, in which the scan electrode and the sustain electrode are formed parallel to each other. Wall charges generated upon plasma discharging are accumulated on the upper dielectric layer. The protective layer is adapted to prevent damage of the upper dielectric layer due to sputtering caused during plasma discharging, and improve an efficiency of secondary electron emission. As the protective layer, magnesium oxide (MgO) is generally used.

A lower dielectric layer and barrier ribs are formed on the lower substrate 118, in which the address electrode is formed. The address electrode is formed in the direction in which the scan electrode and the sustain electrode intersect with each other. The barrier ribs are formed in a stripe or lattice form to prevent ultraviolet light and visible light generated by discharging from leaking toward adjacent discharge cells. The phosphor layer is excited with ultraviolet light generated during the plasma discharging to generate any one visible light of red, green and blue.

The upper substrate 110 and the lower substrate 118 are combined together by the sealant 140 applied around a perimeter edge region of the upper and lower substrates 110 and 118. An inert mixed gas is injected into discharge spaces defined between the upper substrate 110 and the barrier ribs, and between the lower substrate 118 and the barrier ribs. The sealant 140 is initially applied at the perimeter edges of one of the upper substrate 110 and the lower substrate 118, and combines the upper substrate 110 and the lower substrate 118 together.

The black layer 160 is formed at the rear of the upper substrate 110 using a non-conductive paste. More specifically, the black layer 160 is formed between the end of the valid display region A/A and the sealant 140 (from the valid display region A/A to the portion where the sealant 140 is coated). The black layer 160 defines the valid display region A/A of the panel, and also covers unnecessary and/or unsightly portions of the edge portions of the PDP module.

A front filter 130 is formed as a film-type filter on the upper substrate 110 of the PDP. The front filter 130 shields electromagnetic interference (EMI) and also prevents reflection of external light, as shown in FIG. 8. The film-type front filter 130 has the same size as the upper substrate 110 of the panel 100, and includes an anti-reflection film, an optical characteristic film, an EMI shield film and a NIR shield film. Adhesive films are formed between the respective films of the film-type front filter 130, respectively, to provide adhesion among the films. The film type front filter 130 further includes a ground unit 172 formed at an edge region of the anti-reflection film.

The anti-reflection film is formed on a surface of the film-type front filter 130 to prevent externally incident light from reflecting externally again. The anti-reflection film can be additionally formed at the rear of the film type front filter 130. An optical characteristic film serves to lower transmittance of red (R) light and green (G) light among light incident from the panel, and to improve an optical characteristic of the PDP by increasing transmittance of blue (B) light. An EMI shield film shields EMI to prevent EMI, which is incident from the panel, from being discharged externally. A NIR shield film shields NIR incident from the panel. The NIR shield film prevents NIR, over a given reference level, from leaving the panel 100 and being discharged toward the outside so that signals, which are transmitted from a remote controller, etc. to the panel, can be transmitted without interference. The optical characteristic film and the NIR shield film can be formed as a single layer or multiple layers.

The ground unit 172 is electrically connected to a rear cover (not shown) of the panel through a filter support unit (not shown). In the PDP constructed above according to a first embodiment of the present invention, the black layer (formed on the film-type filter in the background art) is now formed in the upper substrate 110 of the panel 100. Thus, only the ground unit 172 is formed in the film-type front filter 130. Accordingly, in the PDP according to the first embodiment of the present invention, the area of the ground unit 172 formed in the edge region of the film-type front filter 130 is larger, as compared to the background art, and a contact resistance between the filter support unit and the ground unit 172 is thereby reduced. Moreover, in the PDP according to a first embodiment of the present invention, a space for forming the ground unit 172 on the film-type front filter is increased, as compared to the background art. Therefore, the assembly process is simplified and the process time to assembly the PDP is shortened, since it is easier to align the filter support unit with the ground unit 172.

Figure 9:
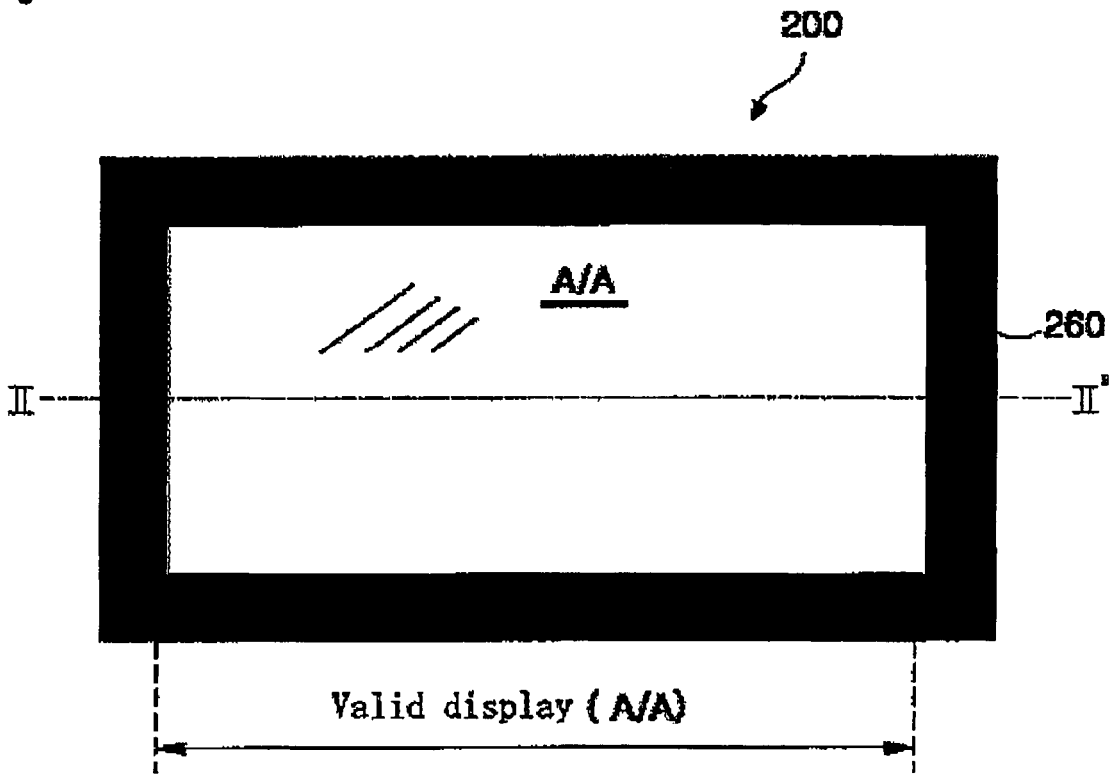
FIG. 9 is a plan view of a PDP according to a second embodiment of the present invention.
Figure 10:
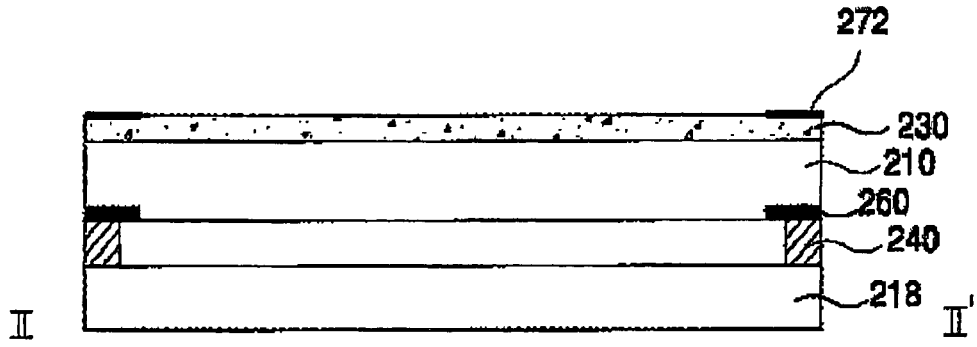
FIG. 10 is a cross-sectional view of the PDP taken along line II-II' in FIG. 9.

Referring to FIGS. 9 and 10, a PDP, according to a second embodiment of the present invention, will be described. A plasma display panel (POP), according to the second embodiment of the present invention, includes a plurality of discharge cells formed on a valid display region A/A of a panel 200, a sealant 240 formed at the perimeter edges of an upper substrate 210 and a lower substrate 218, for combining the upper substrate 210 and the lower substrate 218, and a black layer 260 formed between the end of the valid display region A/A and the end of the upper substrate 210.

Each of the plurality of the discharge cells includes a scan electrode and a sustain electrode (not shown), both of which are formed on the upper substrate 210, and an address electrode (not shown) formed on the lower substrate 218. Each of the scan electrode and the sustain electrode includes a transparent electrode, and a metal bus electrode, which has a line width smaller than that of the transparent electrode and is formed at the end of one side of the transparent electrode.

The transparent electrode is mainly made of indium-tin-oxide (ITO), and is formed on the upper substrate 210. The metal bus electrode is mainly made of a metal, such as chrome (Cr), and is formed on the transparent electrode. The metal bus electrode serves to reduce a voltage drop due to the transparent electrode having a high resistance. An upper dielectric layer and a protection film are laminated on the upper substrate 210, in which the scan electrode and the sustain electrode are formed parallel to each other. Wall charges generated upon plasma discharging are accumulated on the upper dielectric layer. The protective layer is adapted to prevent damage of the upper dielectric layer due to sputtering caused during plasma discharging, and improve an efficiency of secondary electron emission. Magnesium oxide (MgO) is generally used as the protective layer.

A lower dielectric layer and barrier ribs are formed on the lower substrate 218 in which the address electrode is formed. The address electrode is formed in the direction in which the scan electrode and the sustain electrode intersect with each other. The barrier ribs are formed in the stripe or lattice form to prevent ultraviolet and visible light generated by discharging from leaking toward adjacent discharge cells. The phosphor layer is excited with ultraviolet light generated during the plasma discharging to generate any one visible light of red, green and blue.

The upper substrate 210 and the lower substrate 218 are combined together by the sealant 240 formed in the edge region. An inert mixed gas is injected into discharge spaces defined between the upper substrate 210 and the barrier ribs, and between the lower substrate 218 and the barrier ribs. The sealant 240 is initially applied to the perimeter edges of one of the upper substrate 210 and the lower substrate 218, and combines the upper substrate 210 and the lower substrate 218 together.

The black layer 260 is formed at the rear surface of the upper substrate 210 using nonconductive paste. More specifically, the black layer 260 is formed from the end of the valid display region A/A and the end of the upper substrate 210 (from the valid display region A/A to the portion where the sealant 240 is coated), thus covering the sealant 240. The black layer 260 defines the valid display region A/A of the panel, and also covers unnecessary, unsightly edge portions of the PDP module.

A front filter 230, being a film-type filter, is formed on the upper substrate 210 of the PDP. The front filter 230 shields electromagnetic interference (EMI) and also prevents reflection of external light, as shown in FIG. 10. The film-type front filter 230 has the same size as the upper substrate 210 of the panel 200, and includes an anti-reflection film, an optical characteristic film, an EMI shield film and a NIR shield film. For a description of the anti-reflection film, the optical characteristic film, the EMI shield film and NIR shield film, which constitute the film type front filter 230, reference can be made to the description of the PDP according to the first embodiment of the present invention.

A ground unit 272 is formed at the edge on the anti-reflection film of the film-type front filter 230. The ground unit 272 is electrically connected to a rear cover (not shown) of the PDP through a filter support unit (not shown).

In the PDP, constructed according to the second embodiment of the present invention, the black layer (which is formed on the film-type filter in the background art) is now formed on the upper substrate 110 of the panel 200. Thus, only the ground unit 272 is formed on the film-type front filter 230. Accordingly, in the PDP according to the second embodiment of the present invention, the area of the ground unit 272 formed in the edge region of the film-type front filter 230 is larger, as compared to the background art, and a contact resistance between the filter support unit and the ground unit 272 is reduced. Moreover, in the PDP according to the second embodiment of the present invention, a space for forming the ground unit 272 is increased, as compared to the background art. Therefore, the assembly process is simplified and the assembly process time is shortened.

Figure 11:
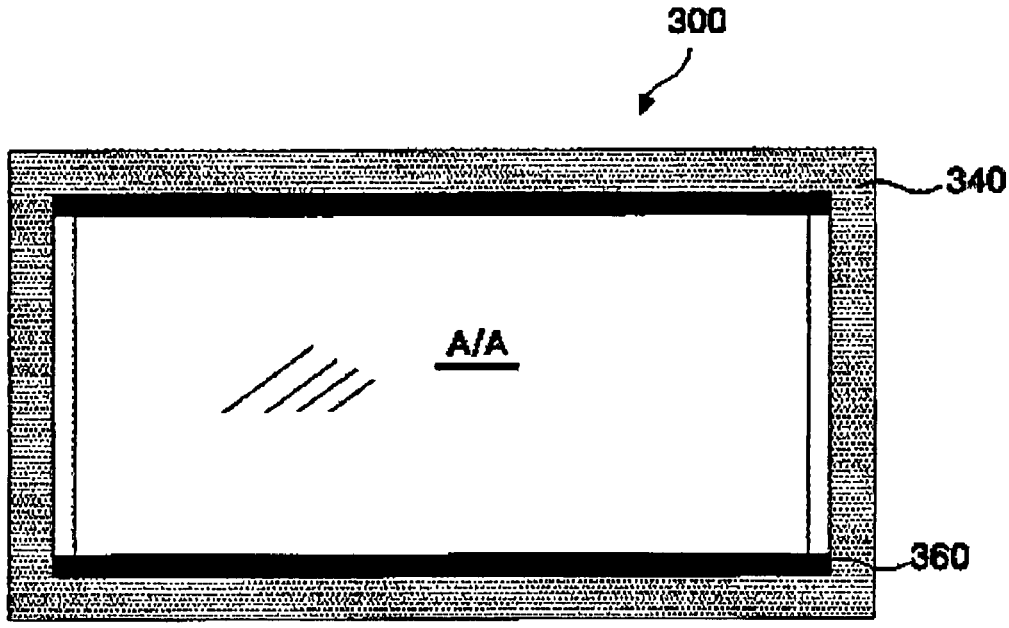
FIG. 11 is a plan view of a PDP according to a third embodiment of the present invention.

Referring to FIG. 11, a PDP, according to a third embodiment of the present invention, is illustrated. All components, except for black layers 360, are the same as those of the PDP according to the first embodiment of the present invention shown in FIGS. 7 and 8. Therefore, in the PDP according to the third embodiment of the present invention, reference can be made to the description of the PDP according to the first embodiment of the present invention for a description of the components other than the black layers 360.

The black layers 360 are formed parallel to each other at upper and lower edges (e.g. top and bottom edges) of the rear surface of the upper substrate using a non-conductive paste. More specifically, the black layers 360 are formed between the top and bottom of the valid display region A/A and the sealant 340 (between the ends of the valid display region A/A on the upper side and portions where the sealants 340 are coated). The black layers 360 define the valid display region A/A of the panel 300, and also cover unnecessary, unsightly edge portions of the PDP module.

In the PDP constructed according to the third embodiment of the present invention, the area of the ground unit formed in the edge region of the film-type front filter is large, as compared to the background art, and a contact resistance between the filter support and the ground area is thus reduced. Furthermore, in the PDP according to the third embodiment of the present invention, a space for forming the ground unit is increased, as compared to the background art. Therefore, the assembly process is simplified and the assembly process time is shortened.

Figure 12:
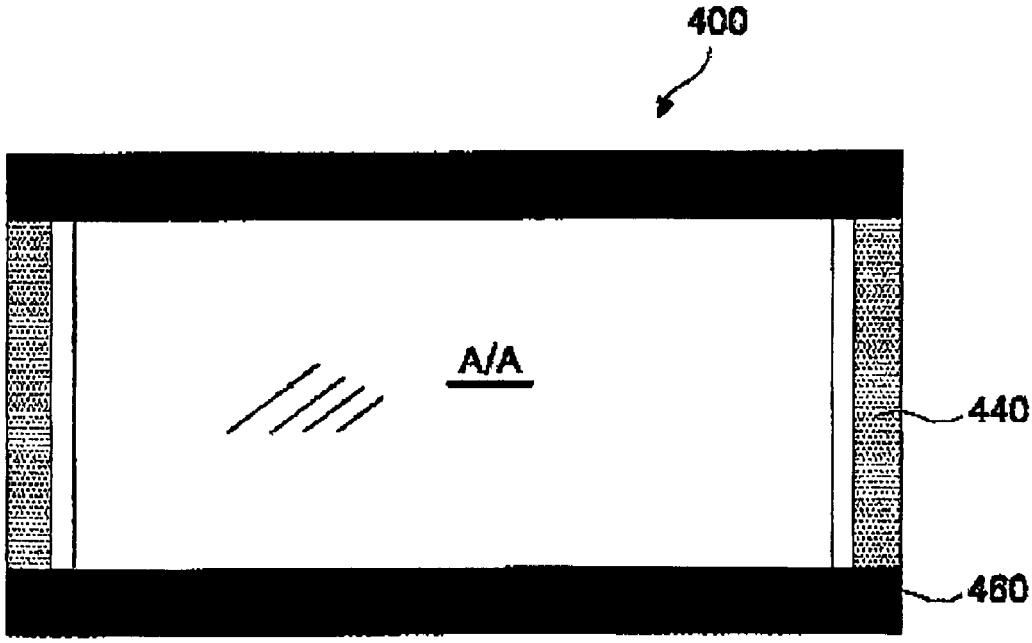
FIG. 12 is a plan view of a PDP according to a fourth embodiment of the present invention.

Referring to FIG. 12, a PDP, according to a fourth embodiment of the present invention, is illustrated. All components, except for black layers 460 are the same as those of the PDP according to the second embodiment of the present invention shown in FIGS. 9 and 10. Therefore, in the PDP according to the fourth embodiment of the present invention, reference can be made to the description of the PDP according to the second embodiment of the present invention for a description of the components, other than the black layers 460.

The black layers 460 are formed parallel to each other at upper and lower edges (e.g. top and bottom edges) of the rear surface of the upper substrate using a non-conductive paste. More specifically, the black layers 460 are formed from the ends of the valid display region A/A to the ends of an upper substrate (from the valid display region A/A to portions where sealants 440 are coated), thereby covering the sealant 440. The black layers 460 define the valid display region A/A of the panel 400, and also cover unnecessary, unsightly edge and sealant portions of the PDP module.

In the PDP constructed according to the fourth embodiment of the present invention, the area of the ground unit formed in the edge region of the film-type front filter is large, as compared to the background art, and a contact resistance between the filter support and the ground unit is thus reduced. Furthermore, in the PDP according to the fourth embodiment of the present invention, a space for forming the ground unit on the film-type front filter is increased, as compared to the background art. Therefore, the assembly process is simplified and the assembly process time is shortened.

Figure 13:
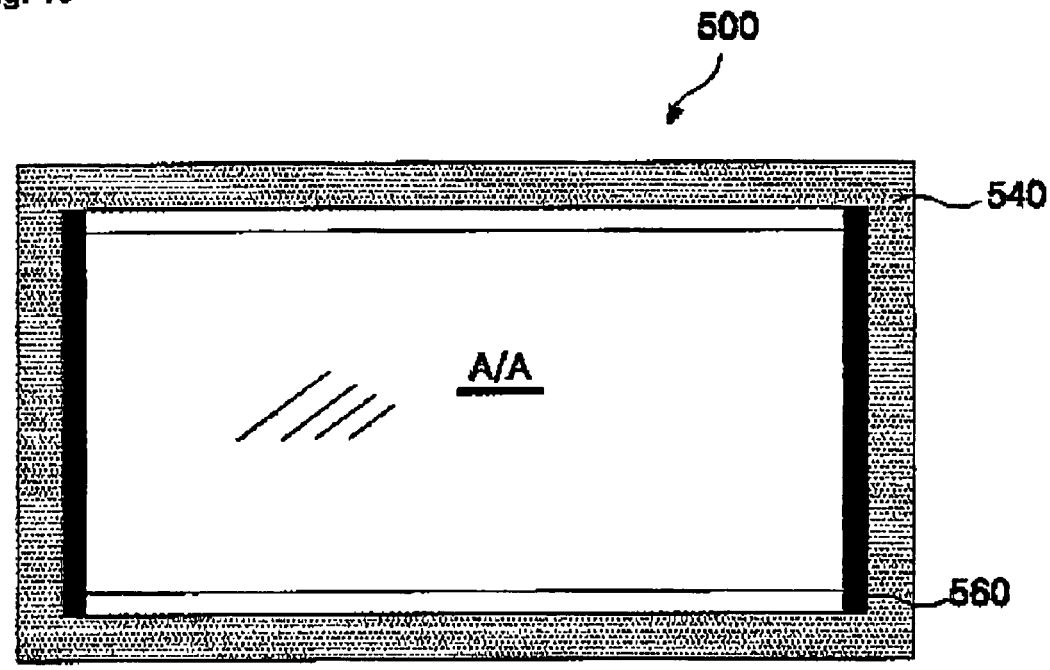
FIG. 13 is a plan view of a PDP according to a fifth embodiment of the present invention.

Referring to FIG. 13, a PDP, according to a fifth embodiment of the present invention, is illustrated. All components, except for black layers 560, are the same as those of the PDP according to the first embodiment of the present invention shown in FIGS. 7 and 8. Therefore, in the PDP according to the fifth embodiment of the present invention, reference can be made to the description of the PDP according to the first embodiment of the present invention for a description of the components, other than the black layers 560.

The black layers 560 are formed parallel to each other at right and left edges of the rear surface of the upper substrate using a non-conductive paste More specifically, the black layers 560 are formed between the right and left ends of the valid display region A/A and the sealant 640 (between the ends of the valid display region A/A on the on the right and left sides and portions where the sealants 540 are coated). The black layers 560 define the valid display region A/A of the panel 500, and also cover unnecessary, unsightly edge portions of the PDP module.

In the PDP constructed according to the fifth embodiment of the present invention, the area of the ground unit formed in the edge region of the film-type front filter is large, as compared to the background art, and a contact resistance between the filter support and the ground unit is thus reduced. Furthermore, in the PDP according to the fifth embodiment of the present invention, a space for forming the ground unit on the film-type front filter is increased, as compared to the background art. Therefore, the assembly process is simplified and the assembly process time is shortened.

Figure 14:
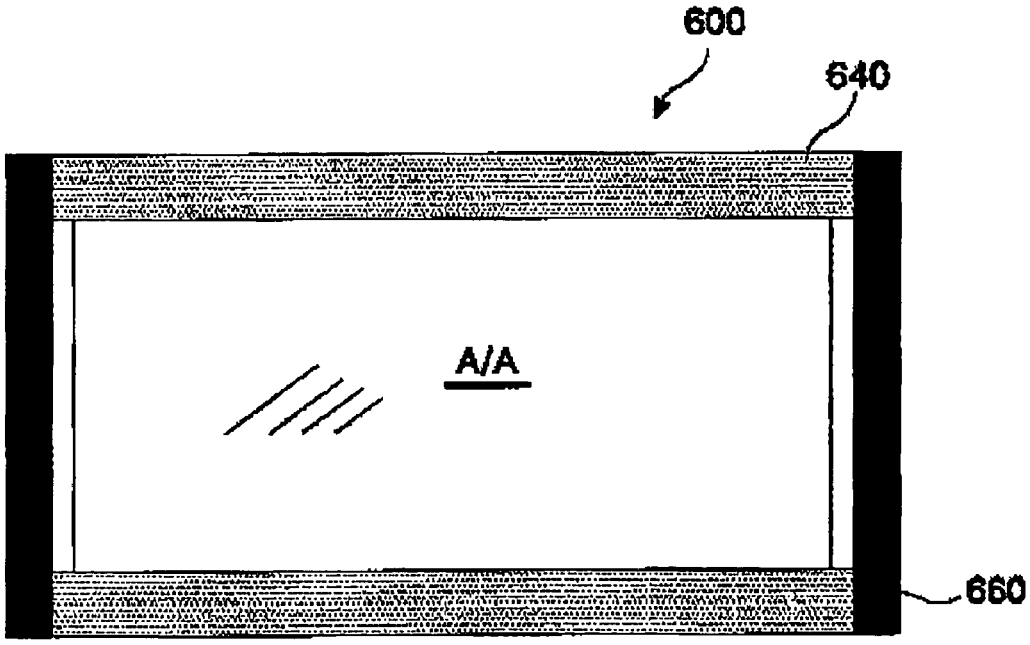
FIG. 14 is a plan view of a PDP according to a sixth embodiment of the present invention.

Referring to FIG-14, a PDP, according to a sixth embodiment of the present invention, is illustrated. All components, except for black layers 660, are the same as those of the PDP according to the second embodiment of the present invention shown in FIGS. 9 and 10. Therefore, in the PDP according to the sixth embodiment of the present invention, reference can be made to the description of the PDP according to the second embodiment of the present invention for a description of the components, other than the black layers 660.

The black layers 660 are formed parallel to each other at right and left edges of the rear surface of the upper substrate using a nonconductive paste. More specifically, the black layers 660 are formed from the ends of the valid display region A/A to the right and left ends of the upper substrate (from the valid display region A/A to portions where sealants 640 are coated), thereby covering the sealant 640. The black layers 660 define the valid display region A/A of the panel 600, and also cover unnecessary, unsightly edge portions of the PDP module.

In the PDP constructed according to the sixth embodiment of the present invention, the area of the ground unit formed in the edge region of the film-type front filter is large, as compared to the background art, and a contact resistance between the filter support and the ground unit is thus reduced. Furthermore, in the PDP according to the sixth embodiment of the present invention, a space for forming the ground unit on the film-type front filter is increased, as compared to the background art. Therefore, the assembly process is simplified and the assembly process time is shortened.

As described above, a PDP in accordance with an embodiment of the present invention includes a black layer formed on an upper substrate, for defining a valid display region of the panel and covering unnecessary edge portions of a POP module. The black layer has been illustrated as being formed on a rear surface of the upper substrate, facing to the lower substrate. However, the black layer could alternatively, or additionally, be formed on an upper surface of the upper substrate, facing to the front film-type filter. By the present invention, the area of a ground unit formed on an edge region of a film-type front filter can be increased in size, as compared to the background art, and a space for forming the ground unit on the film-type front filter can be increased, as compared to the background art. Accordingly, the present invention is advantageous in that the assembly process is simplified and the assembly process time is reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel, comprising:

an upper substrate;

a lower substrate, arranged below said upper substrate;

a display area bordering layer embedded into a lower surface of said upper substrate facing said lower substrate and formed around a perimeter of said upper substrate;

a sealant disposed around a perimeter of said upper and lower substrates to connect and seal said upper and lower substrates to each other; and a chamber located between the upper and lower substrates, said chamber including an inert gas, wherein a corner of the display area bordering layer touches a corner of the sealant but the display area bordering layer does not overlap the sealant.

2. The plasma display panel as claimed in claim 1, wherein said display area bordering layer is dark in color.

3. The plasma display panel as claimed in claim 2, wherein the color of said display area bordering layer is black.

4. The plasma display panel as claimed in claim 1, further comprising:

a film filter disposed on an upper surface of said upper substrate.

5. The plasma display panel as claimed in claim 4, wherein said film filter includes at least two of the following films:

an anti-reflection film;

an optical characteristic film;

an electromagnetic interference (EMI) shielding film; and a near infrared (NIR) shielding film.

6. The plasma display panel as claimed in claim 4, further comprising:

a ground unit formed on an upper surface of said film filter, at or adjacent to at least one side edge of said film filter.

7. The plasma display panel as claimed in claim 6, further comprising:

a support electrically engaging said ground unit of said film filter.

8. The plasma display panel as claimed in claim 1, wherein said display area bordering layer is formed adjacent top and bottom side edges, and adjacent right and left side edges of said upper substrate.

9. The plasma display panel as claimed in claim 8, wherein said display area bordering layer extends from a display area completely to an end of the top, bottom, right and left side edges of said upper substrate.

10. The plasma display panel as claimed in claim 1, wherein said display area bordering layer is formed adjacent top and bottom side edges of said upper substrate.

11. The plasma display panel as claimed in claim 10, wherein said display area bordering layer extends from a display area completely to an end of the top and bottom side edges of said upper substrate.

12. The plasma display panel as claimed in claim 1, wherein said display area bordering layer is formed adjacent to right and left side edges of said upper substrate.

13. The plasma display panel as claimed in claim 12, wherein said display area bordering layer extends from a display area completely to an end of the right and left side edges of said upper substrate.

14. The plasma display panel as claimed in claim 1, wherein a thickness of the display area bordering layer is less than a thickness of said upper substrate.

* * * * *